US010888181B1

(12) United States Patent
Williams

(10) Patent No.: US 10,888,181 B1
(45) Date of Patent: Jan. 12, 2021

(54) SHADOW BOX ASSEMBLY

(71) Applicant: Amazing Grace Art and Apparel Collections, LLC, Lithonia, GA (US)

(72) Inventor: Lucille Banks Williams, Lithonia, GA (US)

(73) Assignee: Amazing Grace Art and Apparel Collections LLC, Lithonia, GA (US)

( * ) Notice: Subject to any disclaimer, the term of this patent is extended or adjusted under 35 U.S.C. 154(b) by 0 days.

(21) Appl. No.: 16/823,278

(22) Filed: Mar. 18, 2020

(51) Int. Cl.
*A47G 1/06* (2006.01)
*A47G 1/12* (2006.01)

(52) U.S. Cl.
CPC ..... *A47G 1/0616* (2013.01); *A47G 1/12* (2013.01)

(58) Field of Classification Search
CPC ..... A47G 1/0616; A47G 1/12
See application file for complete search history.

(56) References Cited

U.S. PATENT DOCUMENTS 2,312,007 A * 2/1943 Thrasher ..... G09F 1/12 40/800
4,215,499 A 8/1980 Wilson
5,057,344 A * 10/1991 Mealey ..... A01G 5/04 428/13
5,388,202 A 2/1995 Squires et al.
5,730,291 A * 3/1998 Smallwood ..... G09F 3/20 206/455
5,806,223 A 9/1998 Visagie
5,896,690 A 4/1999 Suesholtz
6,039,495 A 3/2000 Zimmerman et al.
6,655,064 B1 12/2003 Dodson
6,668,477 B1 12/2003 Cannady
8,595,968 B2 12/2013 Byfield
8,595,969 B1 * 12/2013 Wheelis ..... A47F 3/005 206/777
2002/0100200 A1 * 8/2002 Callander ..... A47G 1/0616 40/800
2002/0108286 A1 * 8/2002 Brockley ..... A47G 1/0616 40/800
2002/0174584 A1 * 11/2002 White ..... A47G 1/0616 40/800
2004/0262184 A1 * 12/2004 Livesay ..... A47G 1/12 206/471

FOREIGN PATENT DOCUMENTS

WO WO9855982 12/1998

* cited by examiner

*Primary Examiner* — Gary C Hoge
(74) *Attorney, Agent, or Firm* — Mark C. Johnson; Johnson Dalal

(57) ABSTRACT

A shadow box assembly adapted for quick and easy insertion and removal of artistic works that includes a frame member, a shadow box insert member, and a frame backing member wherein the shadow box insert member may be of a substantially pliable and selectively adjustable material to accommodate a closer view, and more secure fit, of the shadow box work therein. The shadow box assembly may further comprise an insertion slot or access mechanism wherein shadow box work can be quickly and efficiently inserted and extracted. A locking mechanism may further complement the insertion slot or access mechanism for sealing of the same and securement of the shadow box work therein. The shadow box assembly may be displayed by hanging it on a wall, propping it up against a wall or other vertical structure, or standing it in an upright position on a flat surface or shelf.

14 Claims, 4 Drawing Sheets

100

SHADOW BOX ASSEMBLY

FIELD OF THE INVENTION

The present invention relates generally to shadow boxes, and, more particularly, relates to shadow boxes that are adapted for quick and easy insertion and removal of artistic works.

BACKGROUND OF THE INVENTION

A shadow box is an enclosed display case, generally having a glass-front door, that houses an object or objects presented in a thematic grouping with artistic or personal significance (generally referred to herein as a "shadow box work"). The grouping of the objects and the depth effect created by their relative heights from the backing creates a dramatic visual result. While shadow boxes have a strong tradition in military history, they are also frequently created purely for artistic goals. Shadow boxes are sometimes built by amateur crafters, as a way of preserving and presenting artifacts of historic or personal nostalgic value. These shadow boxes may appear in an exhibition, museum, retail store, restaurant, or house.

Regardless of the purpose, shadow boxes generally include an outer sidewall surrounding a shelf or lower wall and a rear wall. The shelf and/or lower wall and/or the rear wall may structurally support the shadow box work. When the shadow box work is supported, it can then be viewed through a front transparent or translucent cover that may selectively removably couple thereto, e.g., using a hinge. However, many users find the form and structure of existing shadow boxes inconvenient insofar as the structure obligates the user to stand the shadow box work in an upright position on a shelf or other flat surface, thereby taking up substantial surface space. Further, existing shadow boxes entail the use of a hinge or other opening/closing mechanism that requires the user to open the entire shadow box display and arrange each shadow box work that the user desires to display therein. Typically, the shadow box work sits on the shelf and/or lower wall of the shadow box display without being attached or appended to anything, making it vulnerable to damage if the shadow box display is disturbed.

Therefore, a need exists to overcome the problems with the prior art as discussed above.

SUMMARY OF THE INVENTION

The invention provides a shadow box assembly that overcomes the hereinafore-mentioned disadvantages of the heretofore-known devices and methods of this general type and that facilitates the more efficient use of space while giving users the option of how to display the shadow box assembly, i.e. by hanging the shadow box assembly on a wall, propping it up against a wall, or standing it upright on a flat surface. Users can quickly and easily change out the contents within the shadow box assembly and, in one embodiment, may change the amount of free space between the shadow box work therein and the front cover in order to accommodate a closer view of the shadow box work within the shadow box assembly. Users may also selectively arrange the shadow box work therein to prevent the free movement of the same by attaching it to a substantially rigid backing member or by reducing the volume of free space within the shadow box assembly through manipulation of the shadow box insert member.

With the foregoing and other objects in view, there is provided, in accordance with the invention, a shadow box assembly comprising a substantially rigid frame member with a front surface, a rear surface opposing the front surface of the frame member, an outer continuous perimeter edge, and an inner continuous perimeter edge. The inner continuous perimeter edge opposes the outer continuous perimeter edge, and encloses and defines an enclosed inner frame aperture defining a viewing area, the frame member having a substantially rigid frame backing member coupled thereto.

In accordance with another feature, one embodiment of the present invention further includes a shadow box insert member with an outer face, a continuous sidewall surrounding, and disposed in an upright orientation and configuration with respect to, the outer face, disposed proximal to the inner continuous perimeter edge of the substantially rigid frame member, and protruding in a direction outwardly away from the front surface of the substantially rigid frame member.

The outer face and the continuous sidewall of the shadow box insert member define a shadow box cavity of a box area defined by an inner diameter length and an inner diameter width separating the continuous sidewall of the shadow box insert member, the box area corresponding in shape to and less than the viewing area.

In accordance with another embodiment of the present invention, the shadow box assembly comprises a substantially rigid frame member with a front surface, a rear surface opposing the front surface of the frame member, and an outer continuous perimeter edge. An inner continuous perimeter edge opposes the outer continuous perimeter edge, and encloses and defines an enclosed inner frame aperture defining a viewing area. The frame member has a substantially rigid frame backing member coupled thereto, and an insertion slot defined by the substantially rigid frame member and having a width lesser than a frame member width.

In accordance with a further feature of this embodiment, the invention further comprises a shadow box insert member with an outer face, a continuous sidewall surrounding, and disposed in an upright orientation and configuration with respect to, the outer face, disposed proximal to the inner continuous perimeter edge of the substantially rigid frame member, and protruding in a direction outwardly away from the front surface of the substantially rigid frame member. The outer face and the continuous sidewall of the shadow box insert member define a shadow box cavity of a box area defined by an inner diameter length and an inner diameter width separating the continuous sidewall of the shadow box insert member, the box area corresponding in shape to and less than the viewing area.

In accordance with yet another feature, an embodiment of the present invention includes an outer face and continuous sidewall comprised of a substantially pliable material capable of being easily manipulated and influenced. This flexibility facilitates a closer view of, and more secure fit around, the shadow box work within the shadow box assembly because less free space is maintained between the shadow box work and the outer face.

Although the invention is illustrated and described herein as embodied in a shadow box assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the assembly. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to a direction of the shadow box spanning from a bottom end to a top end. The term "traverse" should be understood to mean in a direction corresponding to a direction horizontally across the shadow box, spanning from left to right and vice versa.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
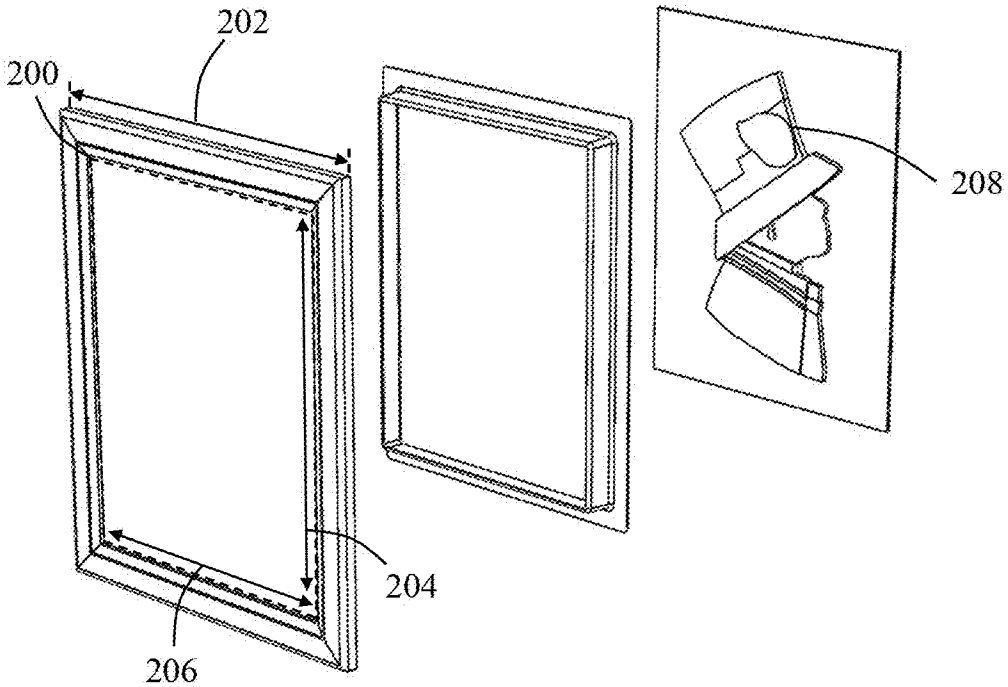
FIG. 2 is an exploded view of the shadow box assembly in FIG. 1 with a shadow box work for utilization therein.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient assembly for the display of creative works of art and memorabilia. Embodiments of the invention provide for a shadow box assembly comprised of three components, any combination of which may, in various embodiments of the present invention, be combined together or be divisible into distinct components. In addition, embodiments of the invention provide for the quick and easy insertion of shadow box work into the shadow box assembly, through either an insertion slit at the top of the shadow box assembly or through disassembly of at least one of the component parts, placement of the shadow box work therein, and re-assembly of the component parts.

Figure 4:
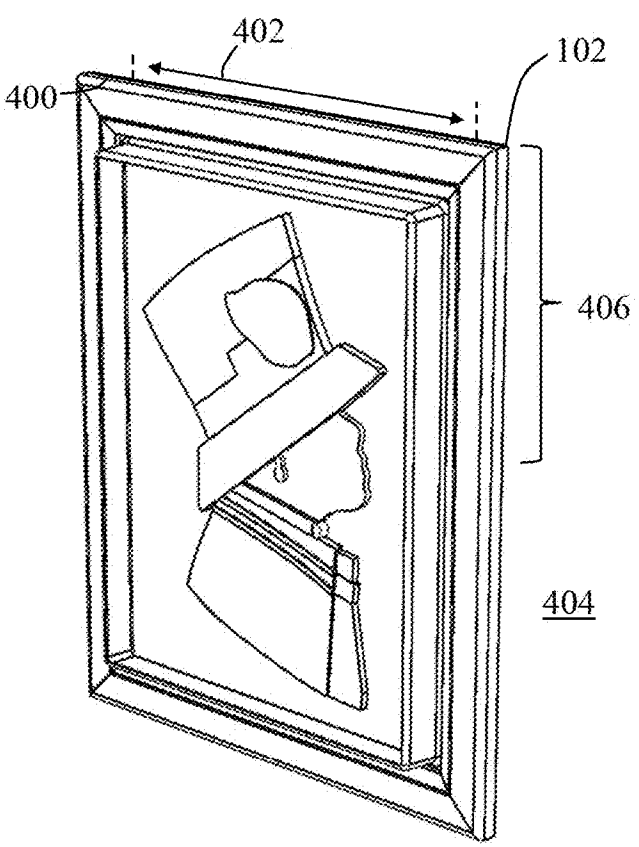
FIG. 4 is a perspective view of a shadow box assembly with a shadow box work utilized therein in accordance.

It should be understood that terms such as, "front," "rear," "side," top," "bottom," and the like are indicated from the reference point of a viewer viewing the shadow box assembly 100 from a front surface 108 when the assembly 100 is disposed on a wall 404 (see FIG. 4).

As used herein, the term "wall" is intended broadly to encompass continuous structures, as well as, separate structures that are coupled together so as to form a substantially continuous external surface.

Figure 1:
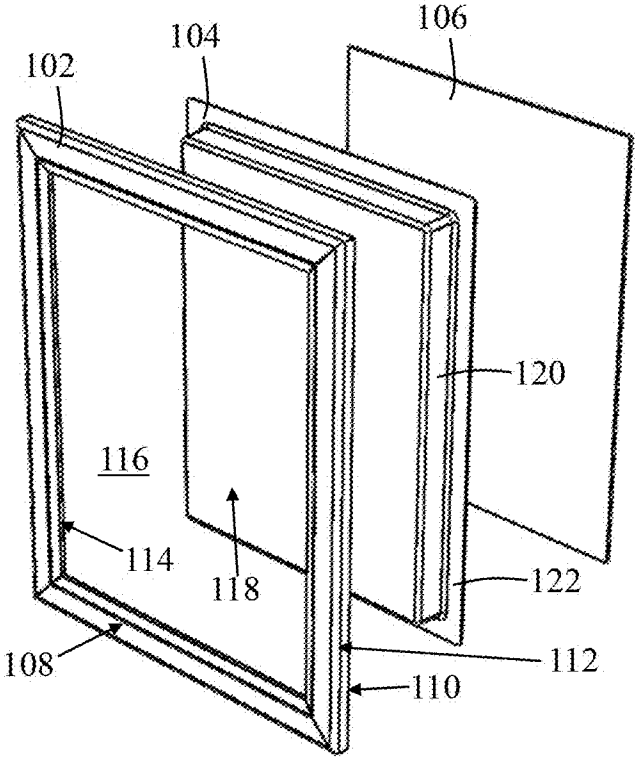
FIG. 1 is an exploded view of a shadow box assembly in accordance with one embodiment of the present invention.

Referring now to FIG. 1, one embodiment of the present invention is shown in an exploded view. FIG. 1 shows several advantageous features of the present invention, but, as will be described below, the invention can be provided in several shapes, sizes, combinations of features and components, and varying numbers and functions of the components. The first example of a shadow box assembly 100, as shown in FIG. 1, includes a substantially rigid frame member 102 with the front surface 108 and a rear surface 110 opposing the front surface 108 of the frame member 102.

The substantially rigid frame member 102 may be of a variety of materials such as wood, metals, e.g. silver, bronze, aluminum, and stiff plastics such as polystyrene. Any one of these material compositions may be used to achieve the function of the substantially rigid frame member 102, which is to provide a consistent shape, form, and structure to the shadow box assembly 100. The size and structure of the substantially rigid frame member 102 may further aid in the desired display and visibility of a shadow box work 208, which may itself vary in size and structure. The substantially rigid frame member 102 may also serve a creative or artistic function insofar as it features an element, design, or quality intended to be aesthetically pleasing to the viewer.

The substantially rigid frame member 102 further comprises an outer continuous perimeter edge 112 and an inner continuous perimeter edge 114, opposing the outer continuous perimeter edge 112. The inner continuous perimeter edge 114 encloses and defines an enclosed inner frame aperture 116, defining a viewing area 200. As used herein, "area" refers to a two-dimensional measurement of space, i.e. length multiplied by width. As best seen in FIG. 2, the viewing area 200 is defined by, and may be measured by multiplying, an inner frame length 204 by an inner frame width 206.

In accordance with a further feature of the present invention, the substantially rigid frame member 102 has a substantially rigid frame backing member (herein referred to as the "frame backing member") 106 coupled thereto. In an embodiment of the present invention, the frame backing member 106 is substantially planar and of a shape and size corresponding to the viewing area 200. A function of the frame backing member 106 is to provide structural support to the shadow box assembly 100 in such a way that the shadow box work 208 remains securely within the shadow box assembly 100, particularly during transportation or use. In one embodiment, the shape and size of the frame backing member 106 is proportionate to the viewing area 200 so that the frame backing member 106 is the same shape as the viewing area 200 and has the same, or larger, length and width as the viewing area 200. In other embodiments, however, the size and shape of the frame backing member 106 may not correspond to the viewing area 200 but may nevertheless provide sufficient support to the shadow box work 208, serving its intended function. This may be accomplished where the frame backing member 106 is of a substantially rigid material, such as wood, metals, e.g. silver, bronze, aluminum, or stiff plastics such as polystyrene. In preferred embodiments of the invention, the frame backing member 106 is substantially planar, wherein "planar" is defined as a flat or two-dimensional surface. This feature facilitates the convenient and unobstructed hanging of the shadow box assembly 100 onto the wall 404, if the user desires to display the shadow box assembly 100 in this manner.

A further feature of the present invention, such as a hook or clasp, may be disposed on the frame backing member 106, giving a user the option to attach the shadow box work 208 directly onto the frame backing member 106 in such a way that the free movement of the shadow box work 208 is substantially restricted and the shadow box work 208 remains in a substantially stable and singular position when disposed within the shadow box assembly 100.

In accordance with a further feature of the shadow box assembly 100, the present invention also comprises a shadow box insert member 104 with an outer face 118 and a continuous sidewall 120 surrounding, and disposed in an upright orientation and configuration with respect to, the outer face 118, disposed proximal to the inner continuous perimeter edge 114 of the substantially rigid frame member 102. The outer face 118 protrudes in a direction outwardly away from the front surface 108 of the substantially rigid frame member 102. The outer face 118 is designed to fit in, and in some embodiments through, the inner frame aperture 116 defined by the frame member 102.

Figure 5:
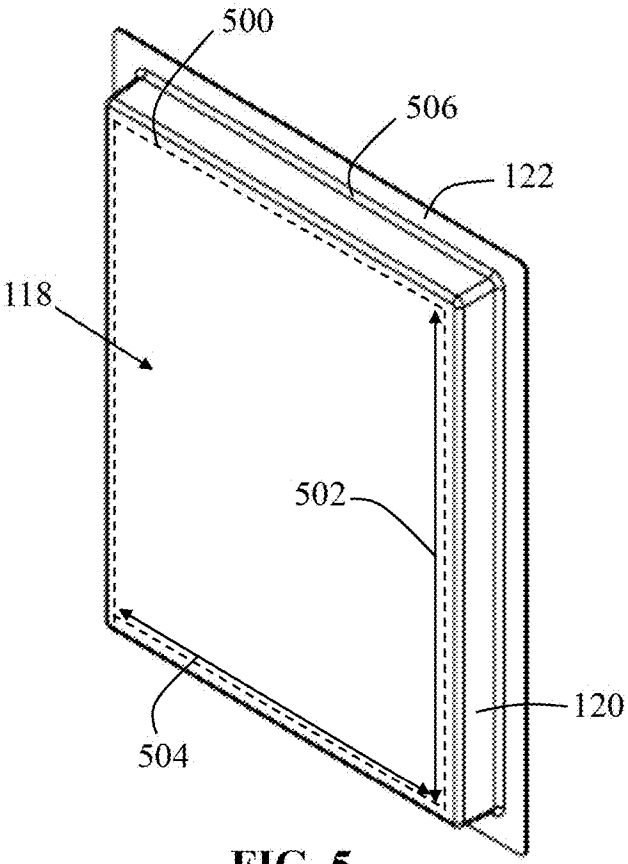
FIG. 5 is a fragmentary perspective view of the shadow box insert member in FIG. 1.
Figure 7:
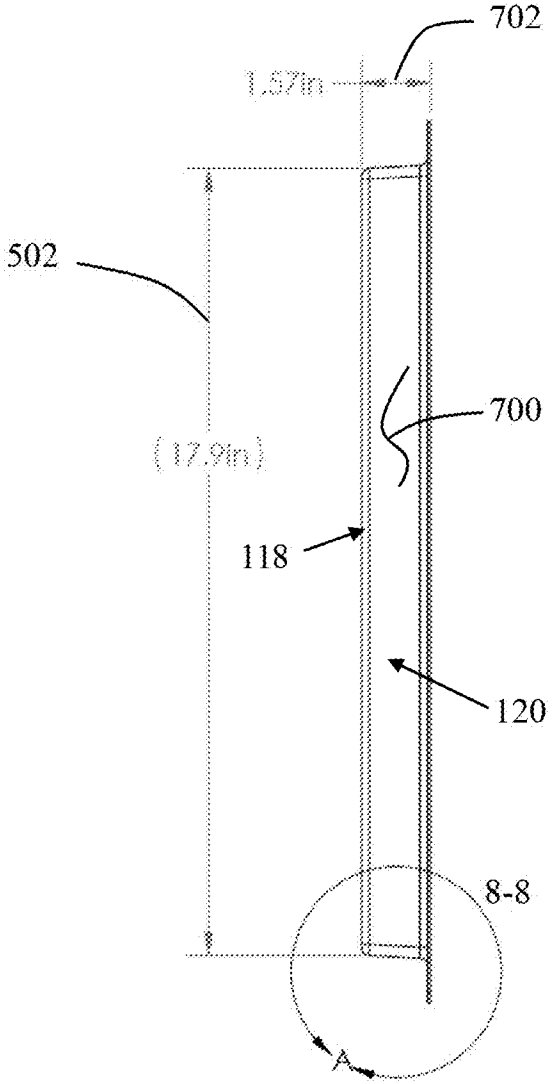
FIG. 7 is a fragmentary elevational front side view of the shadow box insert member in FIG. 5.

As best seen in FIG. 5 and FIG. 7, the outer face 118 and the continuous sidewall 120 of the shadow box insert member 104 define a shadow box cavity 700 of a box area 500 defined by an inner diameter length 502 and an inner diameter width 504 separating the continuous sidewall 120 of the shadow box insert member 104, the box area 500 corresponding in shape to and less than the viewing area 200.

Figure 8:
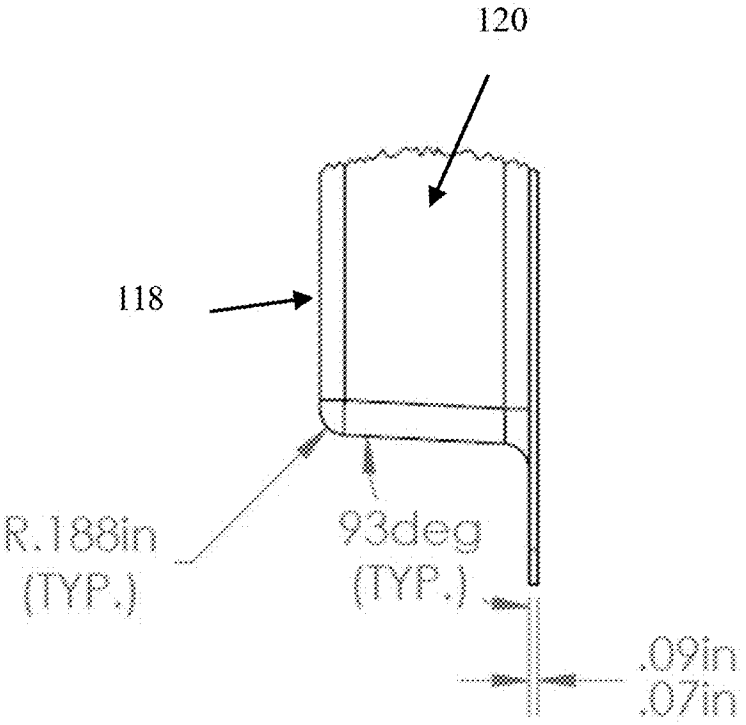
FIG. 8 is a close-up side view of the shadow box insert member in FIG. 5.

In one embodiment of the present invention, the shadow box insert member 104 is of a substantially rigid material, such as a stiff plastic like polystyrene. In this embodiment, the box area 500 is readily discernible by multiplying the inner diameter length 502 by the inner diameter width 504. The box area 500 is typically less than that of the viewing area 200. In accordance with a further feature of this embodiment, the continuous sidewall 120 of the shadow box insert member 104 is disposed in a substantially perpendicular orientation with respect to the outer face 118, as seen in FIG. 7 and FIG. 8-8.

In another embodiment, the shadow box insert member 104 may be of a substantially pliable material, such as a malleable soft polymeric composition, i.e. a flexible plastic. In that embodiment, discerning the precise measurement for the box area 500 may be more difficult but it should nevertheless be less than that of the viewing area 200. Due to the pliability of the shadow box insert member 104 in this embodiment, the outer face 118 and the continuous sidewall 120 may blend into one component or element, as opposed to two distinct elements that are readily discernible. A further feature of this embodiment is the ability of the user to selectively manipulate the shape, form, and size of the shadow box cavity 700. A user may manipulate the shadow box insert member 104 to create a closer or tighter fit between the shadow box work 208 and the outer face 118, thereby accommodating a closer view of the shadow box work 208 within the shadow box assembly 100 and facilitating a more secure hold on the shadow box work 208. This may be done for aesthetic, functional, or convenience purposes, depending on the individual needs of the user.

In one embodiment of the shadow box assembly 100, the frame member 102 may be substantially planar and with a maximum thickness of approximately 2 inches. The frame member 102 may reflect the structure of typical picture frames in that it is substantially planar, wherein "planar" is defined as a flat or two-dimensional surface. Typically, existing picture frames feature protective or decorative edging and molding that makes displaying the work safer and more aesthetically pleasing. The frame member 102 may comprise such decorative molding that aesthetically integrates the shadow box work 208 with the frame member 102. In alternate embodiments, the aesthetic features of the frame member 102 may comprise substantially three dimensional aesthetic or functional features, rather than substantially planar or two-dimensional features. The thickness of the frame member 102 may, therefore, vary depending on the shape and form of the molding on the frame member 102. Preferred embodiments comprise a maximum thickness of approximately 2 inches to accommodate the unobstructed viewing of the shadow box work 208 and to accommodate a sustainable weight of the shadow box assembly 100 that can be consistently supported by a screw, nail, or other device when the assembly 100 is hung on the wall 404.

In accordance with a further feature, the shadow box insert member 104 further comprises a flange 122 coupled to the continuous sidewall 120 and disposed at a flange angle of approximately 90 degrees with respect to the continuous sidewall 120. As best seen in FIG. 5, the flange 122 is a projecting and substantially planar, or flat, rim running along the length of an inner continuous perimeter edge 506 of the continuous sidewall 120. In embodiments where the flange 122 is of a substantially rigid material, such as a stiff plastic like polystyrene, the flange 122 may be disposed at a flange angle of approximately 90 degrees with respect to the continuous sidewall 120. The flange angle, as seen in FIG. 7 and FIG. 8-8, measures 93 degrees in a preferred embodiment of the present invention. In embodiments where the shadow box insert member 104 is of a substantially pliable material, the flexibility of the material may blend the flange 122 and the continuous sidewall 120 into one continuous element wherein the flange 122 and the continuous sidewall 120 are not readily discernible from one another.

Particularly in embodiments where the shadow box insert member 104 is of a substantially rigid material, the flange 122 may serve a supportive function with respect to the attachment and securement of the shadow box insert member 104 to the substantially rigid frame backing member 106 or the frame member 102. The shape and structure of the flange 122 facilitates the convenient attachment of the flange 122 to the substantially rigid frame backing member 106 through a variety of means, including through use of an adhesive, hinge, clasp, screw, nail, or other locking or fastening apparatus. Attachment ensures the shadow box work 208 remains within the shadow box cavity 700 and does not fall out, particularly during use or transportation.

Figure 6:
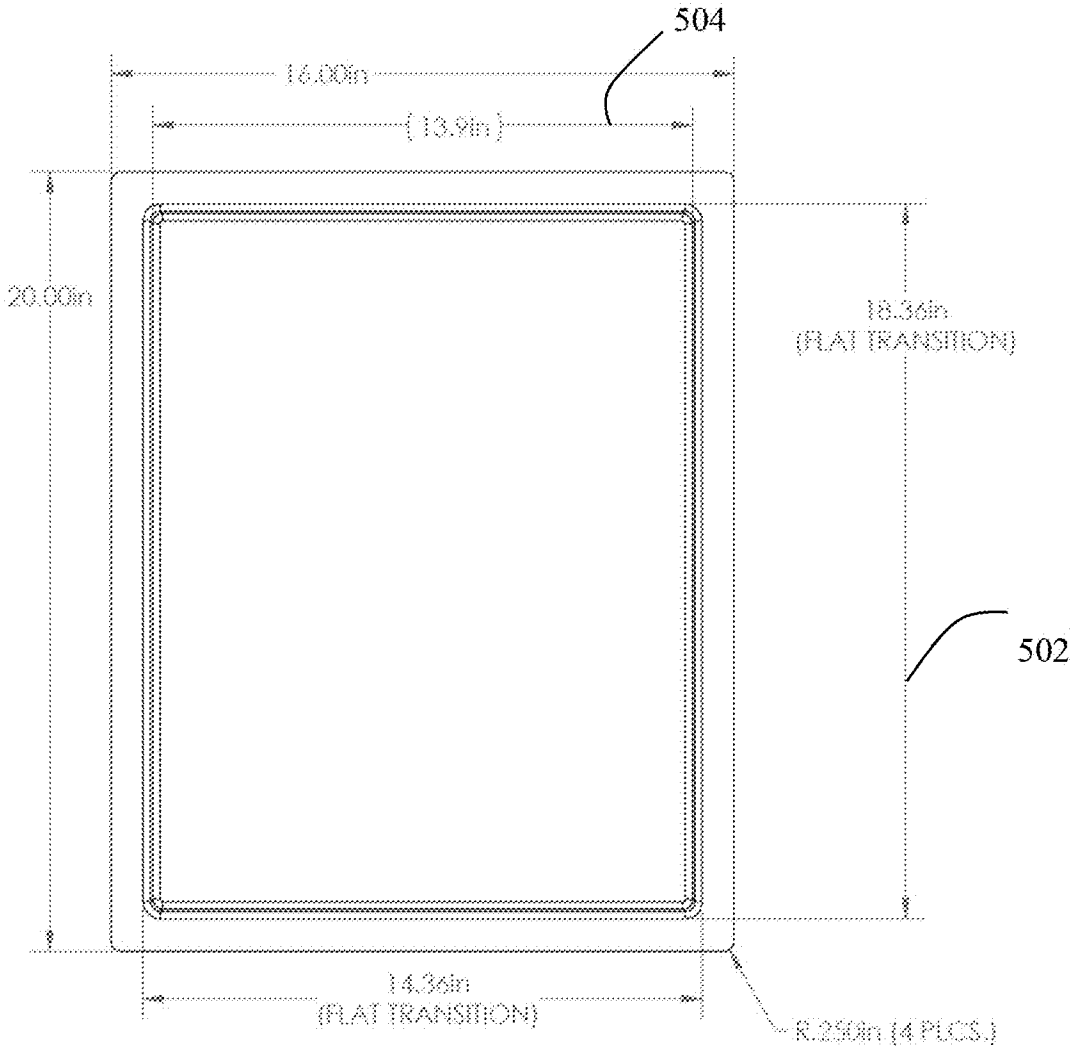
FIG. 6 is a fragmentary elevational front view of the shadow box insert member in FIG. 5.

As seen in FIG. 5 and FIG. 7, the shadow box cavity 700 is defined by the inner diameter length 502, the inner diameter width 504, and the inner diameter depth 702. In a preferred embodiment, depicted in FIG. 6 and FIG. 7, the inner diameter length 502 is approximately 17.9 inches in length, the inner diameter width 504 is approximately 13.9 inches in length, and the inner diameter depth 702 is approximately 1.57 inches in length. In embodiments where the shadow box insert member 104 is comprised of a substantially rigid material, the shadow box cavity 700 comprises a volume equal to the product of the inner diameter length 502, the inner diameter width 504, and the inner diameter depth 702. The volume and dimensions of the shadow box cavity 700 may vary depending on the depth effect the user desires to produce. While exemplary dimensions are provided in FIGS. 6-8, other dimensions may be utilized to carry out the present invention.

In embodiments where the shadow box insert member 104 is comprised of a substantially pliable material, the volume of the shadow box cavity 700 may be more difficult to measure and discern. In this embodiment, the volume and shadow box cavity 700 may be selectively adjustable by a user to accommodate a closer view of the shadow box work 208 through the outer face 118 or to accommodate the size of the generally three dimensional shadow box work 208 disposed within the shadow box cavity 700. Generally, a tighter fit between the shadow box insert member 104, or the outer face 118, and the shadow box work 208 will leave less free space in between the two components and facilitate a more secure fit of the shadow box work 208.

Figure 3:
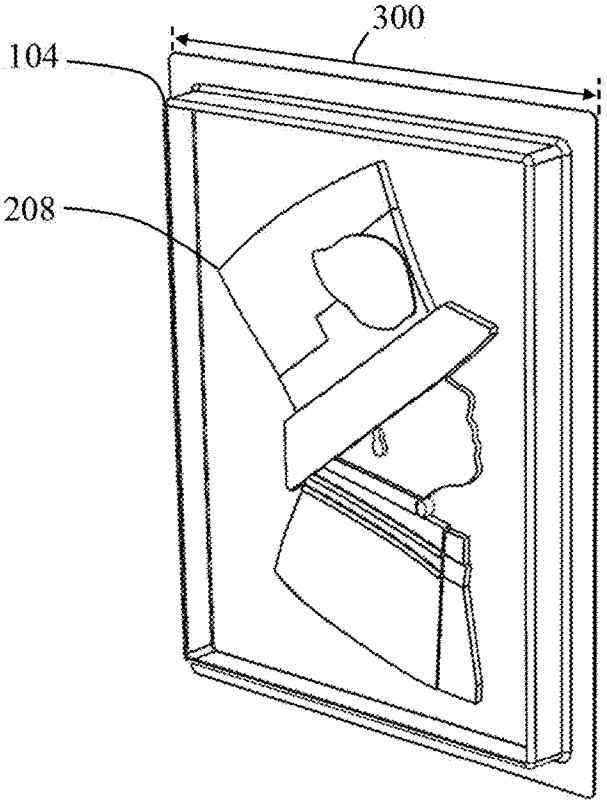
FIG. 3 is a fragmentary perspective view of a shadow box insert member in FIG. 1. with the shadow box work utilized therein.

Referring now to FIG. 3 and FIG. 4, one embodiment of the shadow box assembly 100 features an insertion slot 400 defined by the substantially rigid frame member 102 and of a slot width 402 lesser than a flange width 300 separating opposing sides of the shadow box insert member 104. The insertion slot 400 comprises a defined aperture for the insertion and extraction of the shadow box work 208. In one embodiment, the insertion slot 400 may be of a solid and pre-configured shape and form, facilitating the insertion of only that shadow box work 208 that is dimensionally smaller than the insertion slot 400 and that is capable of fitting through the insertion slot 400. In another embodiment, the insertion slot 400 may be selectively adjustable to accommodate various-sized shadow box work 208 wherein the volume of the shadow box work 208 does not exceed the volume of the shadow box cavity 700. The insertion slot 400 may be disposed on the frame member 102 or on the shadow box insert member 104. In preferred embodiments, the insertion slot 400 is disposed on an upper end 406 of the frame member 102, though the insertion slot 400 may be disposed on any other end or section of the frame member 102 or of the shadow box insert member 104 in alternate embodiments of the present invention.

In another embodiment, the insertion slot 400 is defined by the substantially rigid frame member 102 and the substantially rigid frame backing member 106. The frame member 102 and the frame backing member 106 are operably configured to define the insertion slot 400 when the frame member 102 and the frame backing member 106 are coupled or affixed together through a variety of means, including through use of an adhesive, hinge, clasp, screw, nail, or other locking or fastening apparatus. In this embodiment, the complete shape or outline of the insertion slot 400 is defined only when the frame member 102 and the frame backing member 106 are coupled together or positioned in close proximity to one another.

In yet another embodiment, the insertion slot 400 is defined only by the substantially rigid frame member 102 and is of a slot width 402 lesser than a frame member width 202. The slot width 402 cannot exceed the frame member width 202, but the slot width 402 may be lesser than or equal to the frame member width 202. In certain embodiments, the insertion slot 400 may be selectively adjustable in width or depth to accommodate various-sized shadow box work 208. Selective adjustment of the slot width 402 or slot depth may be accomplished through various aperture control mechanisms known in the art. In one embodiment, the insertion slot 400 is approximately one inch in depth/width and may uniformly span the entire (or at least 80%) of the top portion of the assembly 100 as depicted in FIG. 4.

A further feature of the present invention comprises a locking mechanism disposed on the shadow box assembly 100 and operably configured to selectively seal the insertion slot 400. In accordance with this feature, the locking mechanism facilitates the securement of the shadow box insert member 104 into place, particularly where the shadow box insert member 104 is of a substantially pliable material such as a polymeric bag. The shadow box work 208 is stored inside the shadow box cavity 700 until a user manipulates the locking mechanism to unseal the insertion slot 400 and allow extraction of the shadow box work 208 from therein. Various embodiments may feature variously configured locking mechanisms, or none at all, including locking mechanisms featuring a fastener, hinge, clamp, tongue and groove, or cooperating coupling structures.

The shadow box assembly 100 may lack an insertion slot 400 altogether and instead comprise an access mechanism whereby a user can access the shadow box cavity 700 for insertion or extraction of the shadow box work 208. In one embodiment, this may be done through the de-coupling of at least one of the frame member 102, the shadow box insert member 104, or the frame backing member 106.

At least one of the frame member 102, the shadow box insert member 104, and the frame backing member 106 may be selectively couplable to one another through the use of an adhesive, hinge, clasp, screw, nail, or other locking or fastening apparatus. In one embodiment, the dimensions of the frame member 102, the shadow box insert member 104, and the frame backing member 106 are proportionate to one another and vary marginally, such that a tight fit between them is created when coupled together, creating a secure fit between the frame member 102, the shadow box insert member 104, and the frame backing member 106 without the use of an additional locking or fastening apparatus.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A shadow box assembly comprising:

a substantially rigid frame member with a front surface, a rear surface opposing the front surface of the frame member, an outer continuous perimeter edge, and an inner continuous perimeter edge, opposing the outer continuous perimeter edge, enclosing and defining an enclosed inner frame aperture defining a viewing area, the frame member defining an insertion slot thereon, having a slot width spanning at least 80% of a length separating opposing sides of the frame member and spatially coupled to the enclosed inner frame aperture, and having a substantially rigid frame backing member coupled thereto and having a length and a width; and a shadow box insert member defining a shadow box length opposing two sides thereon, with an outer face, a continuous sidewall surrounding, and disposed in an upright orientation and configuration with respect to, the outer face, disposed proximal to the inner continuous perimeter edge of the substantially rigid frame member, and protruding in a direction outwardly away from the front surface of the substantially rigid frame member, and with a flange coupled to and surrounding the continuous sidewall and terminating at a terminal edge and having a flange width separating terminal edges on opposing sides of the shadow box insert member to define a shadow box insert width, the slot width less than the flange width, the outer face and the continuous sidewall of the shadow box insert member define a shadow box cavity of a box area defined by inner diameter length and an inner diameter width separating the continuous sidewall of the shadow box insert member, the box area corresponding in shape and less than the viewing area, wherein the shadow box insert length and shadow box insert width are proportional to the length and width, respectively, of the frame backing member.

2. The shadowbox assembly according to claim 1, wherein:

the frame member is substantially planar and with a maximum thickness of approximately 2 inches.

3. The shadowbox assembly according to claim 1, wherein the shadow box insert member further comprises:

the flange disposed at a flange angle of approximately 90 degrees with respect to the continuous sidewall.

4. The shadowbox assembly according to claim 3, wherein:

the flange is of a substantially rigid material.

5. The shadowbox assembly according to claim 4, wherein:

the outer face and the continuous sidewall are of a pliable material.

6. The shadowbox assembly according to claim 1, wherein:

the insertion slot is defined by the substantially rigid frame member and substantially rigid frame backing member.

7. The shadowbox assembly according to claim 1, wherein:

the frame backing member is substantially planar and of a shape and size corresponding to the viewing area.

8. The shadowbox assembly according to claim 1, wherein:

the continuous sidewall of the shadow box insert member is disposed in a substantially perpendicular orientation with respect to the outer face.

9. A shadow box assembly comprising:

a substantially rigid frame member with a front surface, a rear surface opposing the front surface of the frame member, an outer continuous perimeter edge, an inner continuous perimeter edge, opposing the outer continuous perimeter edge, enclosing and defining an enclosed inner frame aperture defining a viewing area, the frame member having a substantially rigid frame backing member coupled thereto and having a length and a width, and an insertion slot defined by the substantially rigid frame member and of a slot width lesser than a frame member width and spanning at least 80% of a length separating opposing sides of the frame member and spatially coupled to the enclosed inner frame aperture; and a shadow box insert member defining a shadow box length opposing two sides thereon, with an outer face, a continuous sidewall surrounding, and disposed in an upright orientation and configuration with respect to, the outer face, disposed proximal to the inner continuous perimeter edge of the substantially rigid frame member, and protruding in a direction outwardly away from the front surface of the substantially rigid frame member, and with a flange coupled to and surrounding the continuous sidewall and terminating at a terminal edge and having a flange width separating terminal edges on opposing sides of the shadow box insert member to define a shadow box insert width, the slot width less than the flange width, the outer face and the continuous sidewall of the shadow box insert member define a shadow box cavity of a box area defined by inner diameter length and an inner diameter width separating the continuous sidewall of the shadow box insert member, the box area corresponding in shape and less than the viewing area, wherein the shadow box insert length and shadow box insert width are proportional to the length and width, respectively, of the frame backing member.

10. The shadowbox assembly according to claim 9, wherein the shadow box insert member further comprises:

a flange coupled to the continuous sidewall and disposed at a flange angle of approximately 90 degrees with respect to the continuous sidewall, wherein the flange surrounds the continuous sidewall and is of a substantially rigid material.

11. The shadowbox assembly according to claim 10, wherein:

the outer face and the continuous sidewall are of a pliable material.

12. The shadowbox assembly according to claim 11, further comprising:

an insertion slot defined by the substantially rigid frame member and of a slot width lesser than a flange width separating opposing sides of the shadow box insert member.

13. The shadowbox assembly according to claim 12, wherein:

the insertion slot is defined by the substantially rigid frame member and substantially rigid frame backing member.

14. The shadowbox assembly according to claim 9, wherein:

the frame backing member is substantially planar and of a shape and size corresponding to the viewing area.

* * * * *